US009327287B2

(12) United States Patent
Doppstadt et al.

(10) Patent No.: US 9,327,287 B2
(45) Date of Patent: May 3, 2016

(54) MALLET WITH A CUTTING INSERT AND A BASIC ELEMENT

(75) Inventors: Johann Doppstadt, Velbert (DE); Horst Berger, Calbe/Saale (DE)

(73) Assignee: DOPPSTADT FAMILIENHOLDING GMBH, Velbert (DE)

( * ) Notice: Subject to any disclaimer, the term of this patent is extended or adjusted under 35 U.S.C. 154(b) by 367 days.

(21) Appl. No.: 13/823,289

(22) PCT Filed: Oct. 7, 2011

(86) PCT No.: PCT/EP2011/005008

§ 371 (c)(1),
(2), (4) Date: Mar. 14, 2013

(87) PCT Pub. No.: WO2012/045465

PCT Pub. Date: Apr. 12, 2012

(65) Prior Publication Data

US 2013/0168477 A1 Jul. 4, 2013

(30) Foreign Application Priority Data

Oct. 8, 2010 (DE) ..... 20 2010 014 030 U

(51) Int. Cl.
*B02C 13/28* (2006.01)
*B02C 13/04* (2006.01)
*B02C 18/18* (2006.01)

(52) U.S. Cl.
CPC ..... *B02C 13/28* (2013.01); *B02C 13/04* (2013.01); *B02C 18/18* (2013.01)

(58) Field of Classification Search
CPC ..... B02C 13/04; B02C 13/28; B02C 18/00; B02C 18/16
USPC ..... 241/294
See application file for complete search history.

(56) References Cited

U.S. PATENT DOCUMENTS

| | | | | |
|---|---|---|---|---|
| 2,534,301 | A | 12/1950 | Sennholtz | |
| 7,584,921 | B1 * | 9/2009 | Bennington | B02C 18/145 241/294 |
| 7,959,098 | B2 * | 6/2011 | Doppstadt et al. | 241/197 |
| 2007/0194161 | A1 * | 8/2007 | Doppstadt et al. | 241/294 |

FOREIGN PATENT DOCUMENTS

| | | |
|---|---|---|
| DE | 35 45 708 | 6/1987 |
| DE | 94 15 108.3 | 11/1994 |
| DE | 195 34 033 | 3/1997 |
| DE | 10 2005 023339 | 11/2006 |
| WO | 2009/040061 | 4/2009 |

* cited by examiner

*Primary Examiner* — Mark Rosenbaum
(74) *Attorney, Agent, or Firm* — Jacobson Holman, PLLC.

(57) ABSTRACT

The invention refers to a mallet, in particular for comminution devices with a rotor or at least one shaft, on or at which the mallet (1) can be fastened, consisting of a basic element (2) provided with a through bore hole (B), wherein the through bore hole (B) is provided for connecting the mallet (1) with the rotor or the shaft, and a cutting insert (3) that can be connected releasably/fixedly with the basic element (2) by at least one form-locking connection (V) as well as by at least one connecting means (4), the connecting means (4) exerts power (P) drawing or pressing the cutting insert (3) in the form-locking connection (V) of the basic element (2).
The invention is characterized in that referring to the power (P) a power (P1) results drawing or pressing the cutting insert (3) in a sloping angle (α) with reference to an axis (Y) of the mallet (1) and a symmetry axis (A) of the connecting means (4) essentially parallel to the axis (Y) in the basic element (2).

27 Claims, 8 Drawing Sheets

MALLET WITH A CUTTING INSERT AND A BASIC ELEMENT

Figure 1B:
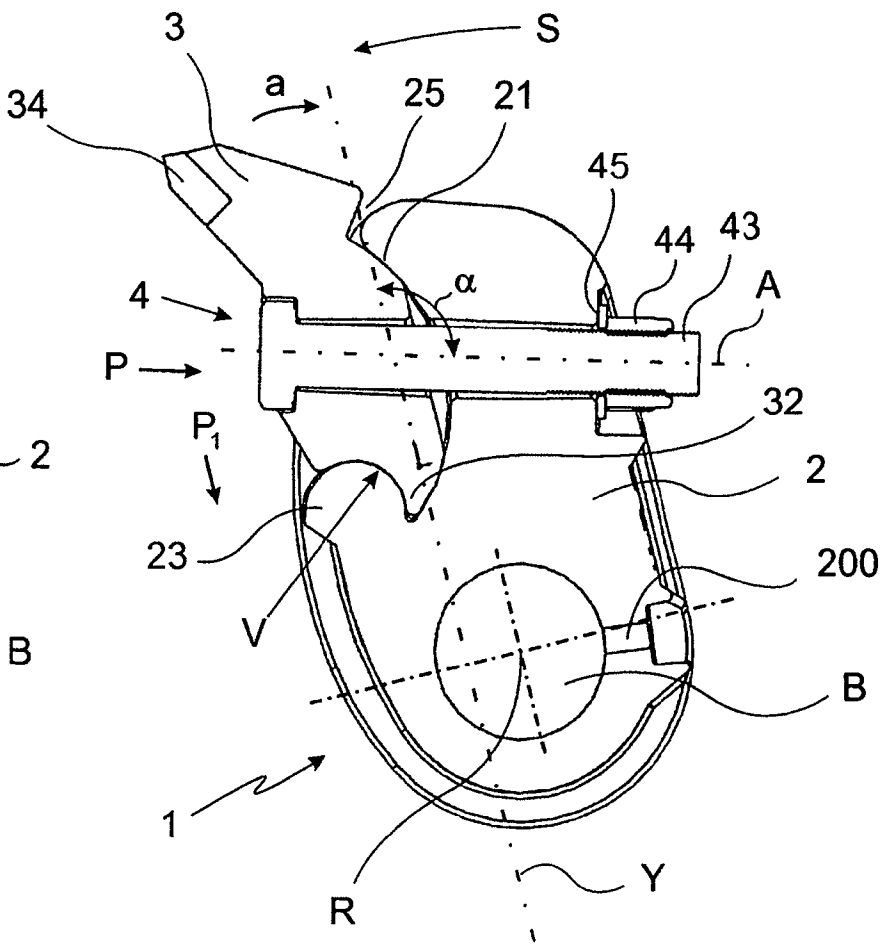

This is a national stage of PCT/EP11/005008 filed Oct. 7, 2011 and published in German, which has a priority of German no. 20 2010 014 030.7 filed Oct. 8, 2010, hereby incorporated by reference.

The invention refers to a mallet, in particular for comminution devices with a rotor or at least one shaft on or at which the mallet can be fixed.

Comminution devices equipped with at least one mallet arranged at a rotor or a rotating shaft in the comminution device and interacting for comminuting the material to be comminuted with a counter cutting edge arranged in the device are known. The problem when servicing the comminution devices equipped with mallets is that the blades or the blade carriers are worn very fast and thus at least the blades or the blade carriers have to be exchanged in regular intervals. The exchange of the blades is time consuming and leads to longer standstill periods of the comminution device.

In the specification DE G 94 15 108.3 a comminution aggregate has become known at the circumference of which cutting tools, in particular mallets, are arranged that are supported on bearings preferably rotating, and that are equipped with counter blades outside the rotor. This comminution aggregate is supposed to be characterized in that the mallet is provided with an exchangeable cutting edge point connected with the mallet by an interlocking profile. The interlocking profile is formed here of grooves and ribs, the cutting edge point and the mallet being connected to each other by a safety element.

In the specification De 10 2005 023 339 A1 a mallet for a rotor shredding machine has become known. This mallet comprises an elongated basic element with a pivot bearing by means of which the mallet can be configured pivoting at a rotor around a pivoting axis parallel to the rotor axis, and with a support surface extending to the free end of the basic element. Furthermore, the mallet has a cutting head with cutting edges projecting at opposite ends, wherein the cutting head is supported on the basic element via the support surface and on structures at support surface and cutting head, provided on the support surface and interlocking complementarily. Furthermore, a releasable connecting means is provided for connecting basic element and cutting head, the connecting means being guided through the complementary structures. For increasing the stability, the complementary structures are formed by a depression, that is formed in the support surface of the basic element, and by a complimentary catch of the cutting head. Furthermore, here the cutting head is protected that has the particular advantage that it can turn by 180°, so that after the first cutting edge is worn out, the second cutting edge can be used. Furthermore, in the specification DE 195 34 033 A1 a mallet for hammer crushers and mills is known. The advantage of this embodiment is the fact that an inner section of the head is imbedded completely in a recess of the basic element.

Also DE 20 2007 013 269 U1 has become known. This is a previous application by the applicant. Here, a mallet is suggested that is characterized in that in the bottom element in the interior of the bottom element a recess is provided in which form-fittingly at least one connecting catch provided at the cutting head engages. It is provided here, that a bottom element and a cutting head interact form-fittingly to form a mallet. This mallet, however, has the disadvantage that the material share of the cutting head or the cutting element compared with the entire material share of the mallet is much too high. The result is that the production of the mallets according to the state of the art requires, of course, clearly more material and, in particular, also the spare parts for the mallet still cause too high costs. Another disadvantage of the solutions known from the state of the art is the fact that the self-centering form-fitting connection is excellent, however, its manufacturing is highly complicated as, for example, V-shaped tapering-off support surfaces have to be created at the cutting element as well as at the bottom element. Therefore, it is necessary to supply certain tools or moulds to press, for example, the parts of the mallet. Manufacturing, in particular J-shaped, form-fitting connections that have to be contained in the bottom element as well as in the cutting element, is also very expensive so that there is the problem of reducing these costs for the production altogether.

Referring to this state of the art, it is the problem of the invention to suggest a mallet, in particular for comminution devices, that does not have anymore the disadvantages known from the state of the art, that can be, in particular, manufactured essentially simpler, and that has a material share with respect to the cutting element that is clearly less than is the case with the solutions of the state of the art.

Referring to this state of the art, the invention suggests a mallet, in particular for comminution devices with a rotor or at least one shaft on or at which the mallet can be fixed, consisting of a basic element provided with a through bore hole, wherein the through bore hole is provided for connecting the mallet with the rotor or the shaft, and a cutting insert that can be connected releasably/fixedly with the basic element by at least one form-locking connection as well as by at least one connecting means, that is characterized in that the connecting means exerts a force drawing or pressing the cutting insert in the form-locking connection of the basic element, and, referring to a first power (P) a second power (P1) results drawing or pressing the cutting insert in a sloping angle ($\alpha$) with reference to an axis (Y) of the mallet and a symmetry axis of the connecting means essentially parallel to the axis (Y) of the mallet in the basic element. This accomplishes that the form-locking connection can be created considerably less complicated because of the configuration of the connecting means. The J-shape that has been used so far, and, in particular, the provision of supporting surfaces shaped V-like or tapering conically outwards are not required anymore.

Furthermore, this embodiment achieves that the material share of the cutting element or the cutting insert is further reduced considerably compared with the basic element. The at least one connecting means connecting the basic element with the cutting element form-lockingly or supporting the form-locking connection by an additional force-locking connection is designed such that the power P drawing or pressing the cutting insert in the form-locking connection of the basic element, is provided in a slightly sloping angle $\alpha$ with respect to the Y-axis of the mallet and the symmetry axis of the connecting means. This kind of design allows configuring the mallet for comminution devices in such a way that the entire mallet consists only of two parts, namely the cutting insert and the basic element, the material share of the cutting insert, as already mentioned, being rather low. The advantages, so far known in the state of the art, according to which the cutting element can be configured, for example, universally for different cutting problems, remain of course. A further result is that the wear concerns actually only the cutting part of the cutting insert, and the basic element is essentially not affected by wear. There are several designing options developing these advantages of the first embodiment of the invention. Compared with the state of the art, the supporting surfaces extending wedge-like inwards are completely dropped. The basic element is further drawn upwards according to the invention, and is realized stronger with reference to weight and volume. The cutting insert, that is integrated in the basic element, is configured on the side interacting with the basic element not anymore completely J-shaped, but only semicircle-like. Because of the fact that the connecting means is integrated with an angle sloping against the cutting direction or against the Y-axis of the basic element, the consequence is that, because of an upper surface, now, seen from the side, not wedge-like but plane, pressure is exerted downwards that then presses the curvature to the correspondingly designed curvature at the basic element. A single connecting means, for example a screw connection, therefore accomplishes here double effect. Furthermore, the invention accomplishes that the blade or the cutting insert altogether have an essentially higher cutting catch that then can be worked off almost to the basic element when used according to its purpose. Besides, there are big advantages with respect to manufacturing as it is not necessary anymore to realize the wedge-like extending sloping inwards or outwards support surfaces that in the state of the art are complicatedly designed or manufactured.

The problem according to the invention is also solved by a mallet, in particular for comminution devices with a rotor or at least one shaft on or at which the mallet can be fastened, consisting of a basic element provided with a through bore hole, wherein the through bore hole is provided for connecting the mallet with the rotor or the shaft, and a cutting catch that can be releasably/fixedly connected with the basic element by at least one form-locking connection as well as by at least one connecting means, the connecting means exerts a power drawing or pressing the cutting insert in the form-locking connection of the basic element, in particular a mallet as described before characterized in that for forming the form-locking connection the cutting insert can be swiveled or rotated in the basic element. Therefore, for example for forming the form-locking connection, a connecting catch at the cutting insert with a connecting knob is provided in the basic element. The connecting catch and the connecting knob have here corresponding shapes. Furthermore, it is provided that the connecting knob with the connecting recess in the basic element or their side limits form a guide for the swiveling-in of the cutting insert. This embodiment also accomplishes the before-described useful effects. This design also serves for solving the problem of the invention as it has been defined in the beginning. Thus, it is now possible, for example, to exchange mallets after wear even more easier, besides the before described effects of material saving, or, when newly equipped with rotors, to put these in the basic element. This can be done without the basic elements being required to be taken out of the rotors. This is done, as usual, by releasing the fastening means and swiveling-out the mallet for removing, or by pushing in and swiveling the mallet during mounting.

The first described embodiment of the invention is characterized in a development of the invention in that the power is provided in a sloping angle with respect to the Y-axis of the mallet and the symmetry axis of the connecting means. The advantages that come with this embodiment have already been described before and are obtained again here in the same way.

Another aspect of the mallet according to the invention is the fact that the connecting means according to angle $\alpha$ is arranged sloping against the cutting direction in the mallet, and creates or effects power P in tightened condition.

Angle $\alpha$ that, as already mentioned, appears between the Y-axis of the mallet and the symmetry axis of the connecting means is here provided in an angle between 91° and 145°, preferably 105°. The result of this configuration is power P1 resulting from power P drawing or pressing the cutting insert in the basic element.

A development of the invention provides that the connecting mean's is a screw connection consisting of connecting bore holes provided correspondingly in the basic element and in the cutting insert, a screw configured preferably as machine screw as well as a nut that is supported preferably by a washer and is secured, if necessary, by means of a circlip against unintended release.

According to the invention, it is provided here that the connecting bore holes are configured conically sloping against the cutting direction. The effect is that the screw of the screw connection can be integrated more easily. Of course, it is also possible to provide appropriate conically bolts corresponding then with the cone of the connecting bore hole to achieve here an additionally securing lock.

Furthermore, the invention suggests that the basic element extends on its side pointing at the cutting insert to a defined distance from a flight circle defined by the blade point of the cutting insert in order to form a supporting area and/or a free cut for the cutting insert. This defined distance from the flight circle of the blade defines accordingly the measure for which the blade point or the cutting insert is provided for working off. When this area has been worked off the cutting insert has to be exchanged. It is an advantage when, referring to the flight circle of the blade point, a free cut is formed with the intended distance that is obtained essentially by a curvature of the basic element in cutting direction that is located exactly in the area where the cutting element is angled in the direction of the blade point.

The distance starting at the flight circle of the blade point of the cutting insert is furthermore defined by the flight circle of the basic element at its point farthest away from the rotational axis. It is now clear which distance is actually available for a material reduction of the cutting insert. This is, according to the invention, considerably larger than with all mallets in the state of the art that have been employed so far and that have become known. The other advantage according to which, despite this enlargement of the working-off height, the material share of the cutting insert is kept very low compared with the basic element, is at the same time surprisingly obtained by the configuration according to the invention.

The entire width of the cutting insert according to the invention is supported, similar to the solutions of the state of the art, on or at the basic element. This guarantees a better transmission of power from the cutting insert to the basic body.

Another aspect of the solution according to the invention is given by the fact that the cutting insert is designed such that it can be at least partly, in particular with its part of the form-locking connection in the basic element. It is preferred here that this part of the form-locking connection is encircled on all sides by the basic element so that only the tip of the insert projects from the basic element. This guarantees that the form-locking connection cannot be damaged by the material to be comminuted or by any contaminations in the material to be comminuted. The form-locking connection of the cutting insert towards the basic element is not completely J-shaped anymore, as in the state of the art, but only shaped semicircle-like. Despite this minimum form-locking connection, the result is an excellent form-locking by this solution such that the screw as connecting means exerts a power drawing or pressing the cutting insert exactly in this from-locking connection of the basic element. Of course, the respective counter surfaces are designed corresponding to each other.

It has been proved here to be an advantage when the support area in the basic element is provided in a connection recess that is limited, at least laterally, by a web each. This also serves as protection for the form-locking connection, and in particular for an improved bond.

According to the invention, the ratio of the cross section surfaces of basic element and cutting insert, and the ratio of the mass of basic element to cutting insert, respectively, is between 1:2 to 1:5, preferably 1:3.

The invention is also characterized in that the cutting insert has a web in the area where the connecting means is provided. The web can have here the same width as the connection recess in the basic element, or it can extend in built-in or assembled condition laterally at least to the edge of the basic element, preferably beyond the edge of the basic element. This configuration has the advantage that thus the basic element is protected even better against wear, and this is in an area that could be reached still by material so far so that wear occurred. In the narrower configuration this web is still configured such that here a wear effect can occur. This is avoided completely by a wider configuration, namely extending to the edge of the basic element and beyond it, respectively.

Furthermore, the invention suggests that for producing the form-locking connection a connection catch is provided at the cutting insert and a connecting knob in the basic element, and the connection catch and the connecting knob have corresponding forms. The advantages of such a configuration have already been described. It has to be stated altogether that this way of the form-locking connection is not so complicated to produce than is the case with the solutions of the state of the art so far.

It is an advantage here when the connecting knob and the connection catch have an exterior radius and interior radius, respectively, of 15-20 mm with reference to a third of a circle of the exterior curvatures and the interior curvatures, respectively, of connecting knob and connection catch.

It is an advantage here when the connecting knob is provided in the front part of the basic element seen in cutting direction.

Furthermore, it is provided according to the invention that the cutting element is designed as exchange blade with at least two cutting points. Thus, such a mallet can also be used for comminuting fibrous and soft wood, such as for example eucalyptus wood.

In a development the invention suggests furthermore that at the cutting element at the edges and/or sides pointing in cutting direction hardened areas, hard facings, welding-ons, hard metal coatings or the like are provided as cutting points. This configuration serves for keeping the effects of wear low and for prolonging the lifetime of the mallet point or the cutting element.

Of course, it is also provided according to the invention that at least the cutting edges of the cutting element are formed of hard metal.

The modifications of mallets already known from the state of the art characterized by different cutting points, are also maintained in the solution according to the invention. Accordingly, a development is characterized in that the cutting points at the cutting insert are characterized by different shapes of the points.

It is also an advantage when the cutting point or cutting points are formed wedge-like and/or V-like in cutting direction. The basic element of the mallet according to the invention has, as also already known in the state of the art, at least one opening provided preferably on the side of the bottom element opposite the cutting direction, extending at least to the through bore hole and serving for holding a lubricator. In the simplest form, this can be, for example, a grease nipple that is operated, for example, by means of a grease gun. Of course, it is also possible to provider other lubricators there.

The invention is also characterized in that the basic element and/or cutting element has been obtained at least partly as forged punched part. This is a very economic way of manufacturing that results in low costs for producing the mallet according to the invention.

Of course, the invention also suggests a comminution device, in particular a chipper, with at least one mallet as it has been described before.

Figure 1A:
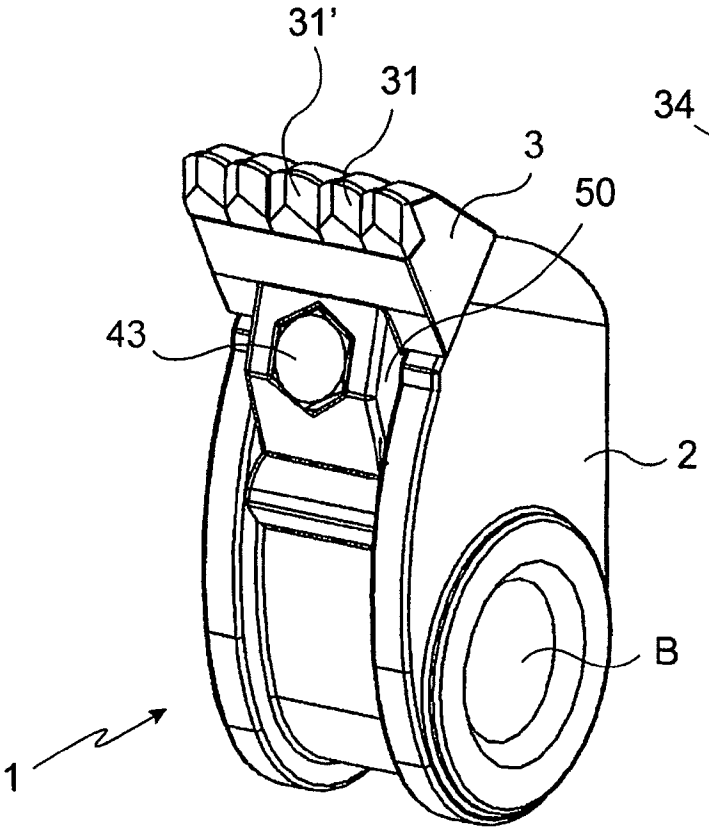
Figure 1C:
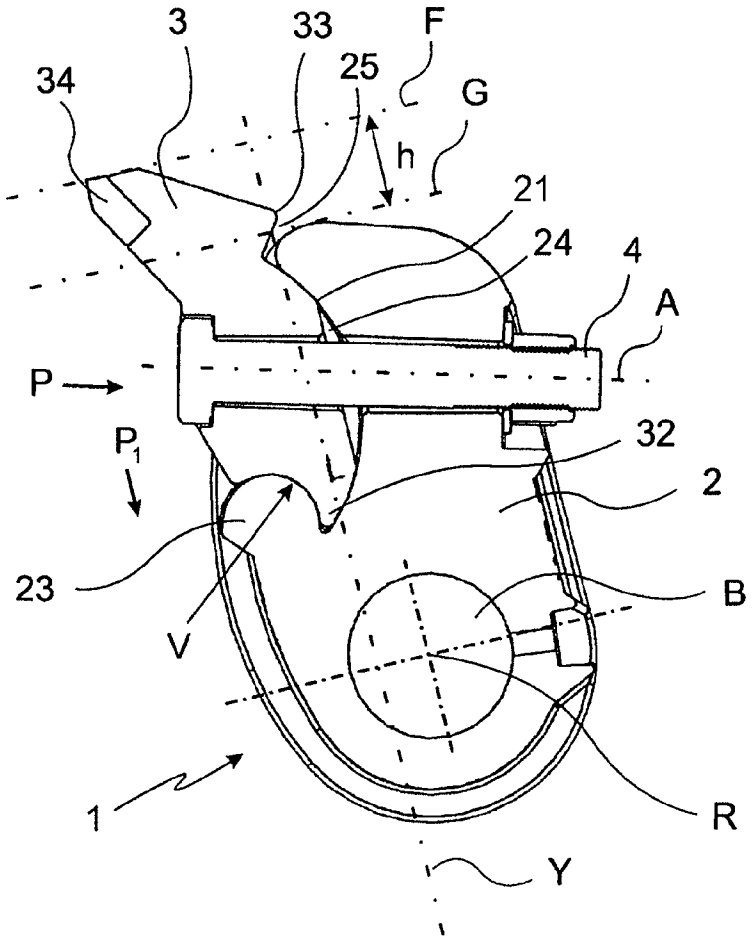
Figure 1E:
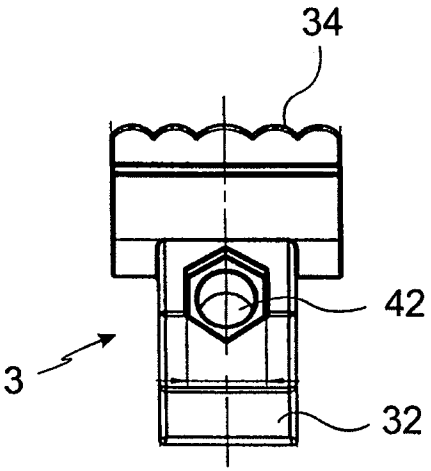
Figure 1F:
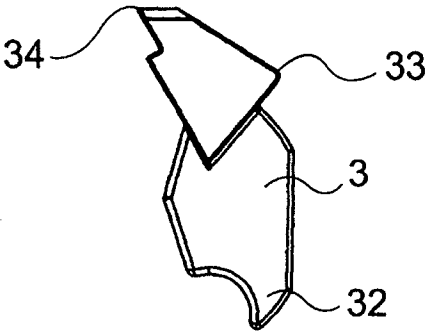
Figure 1D:
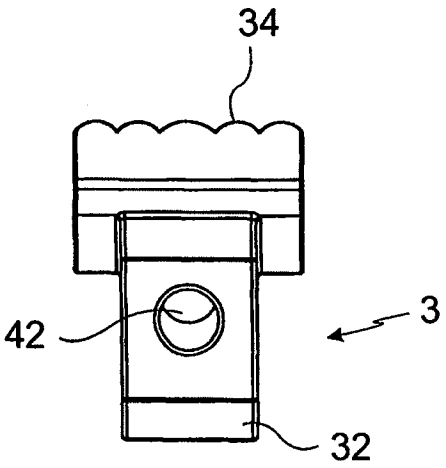
Figure 3:
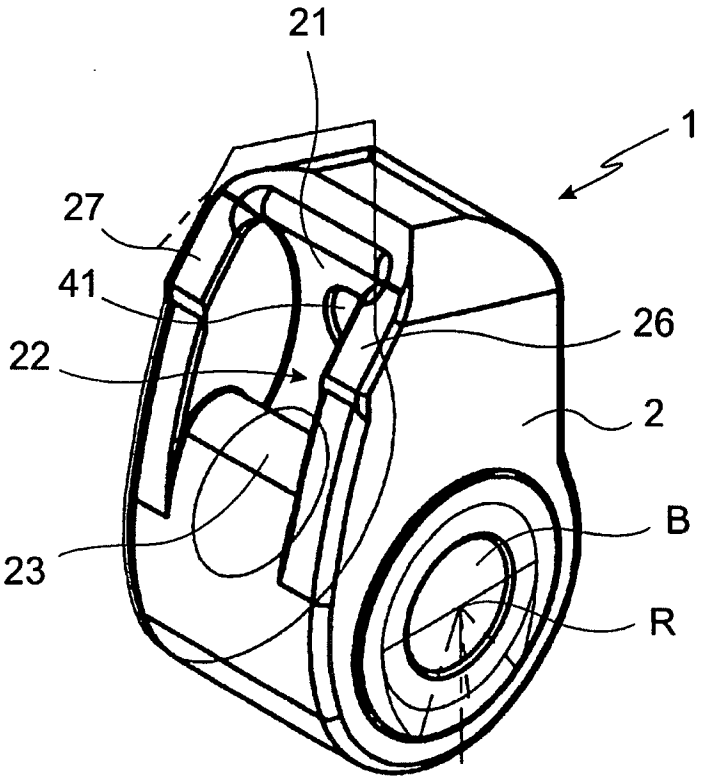
Figure 2:
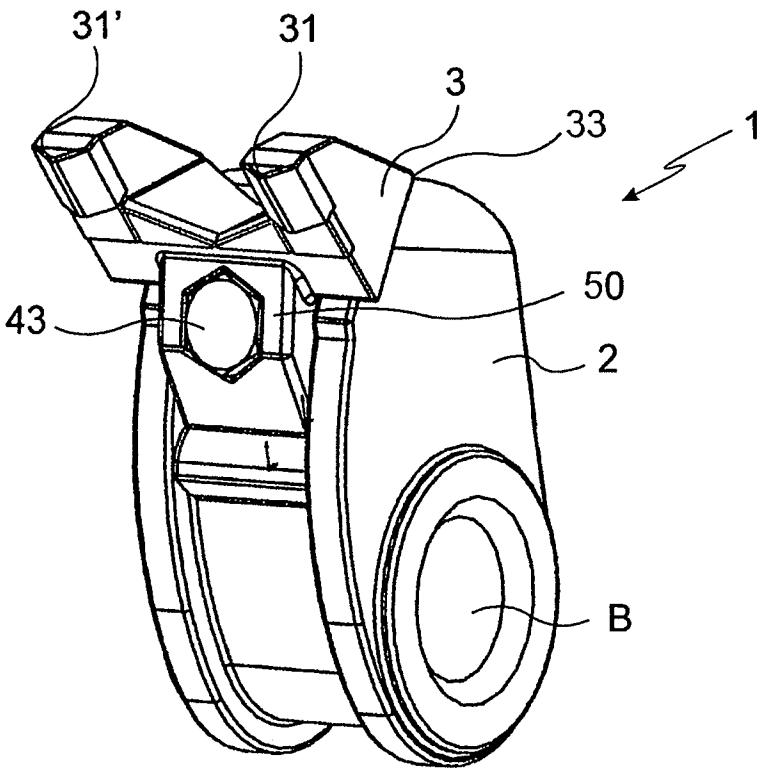
Figure 2B:
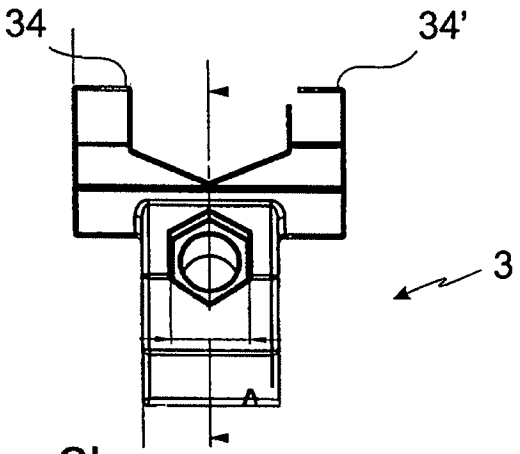
Figure 2A:
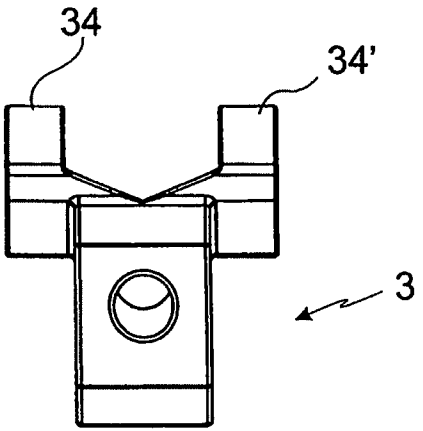
Figure 6:
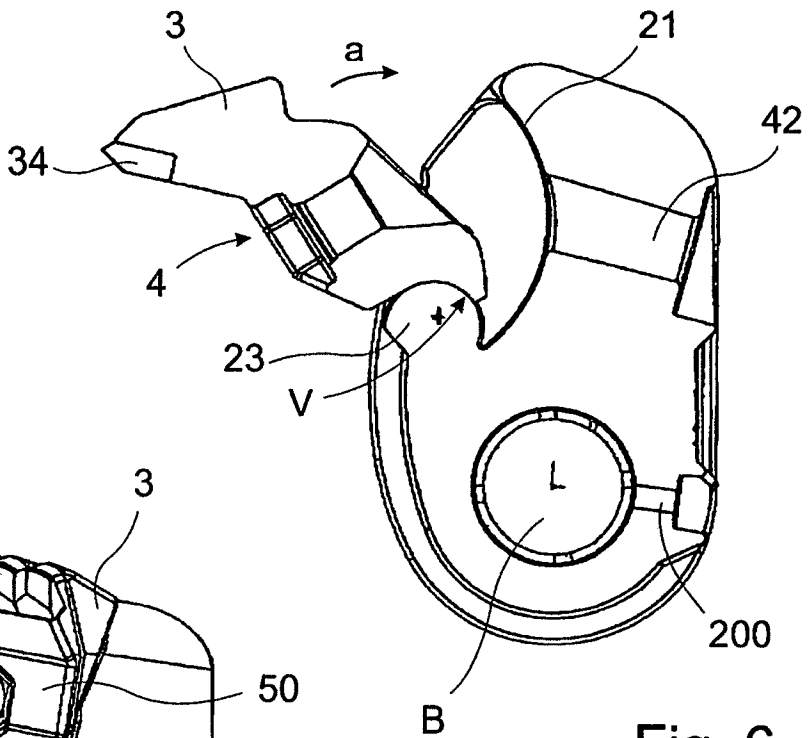
Figure 5:
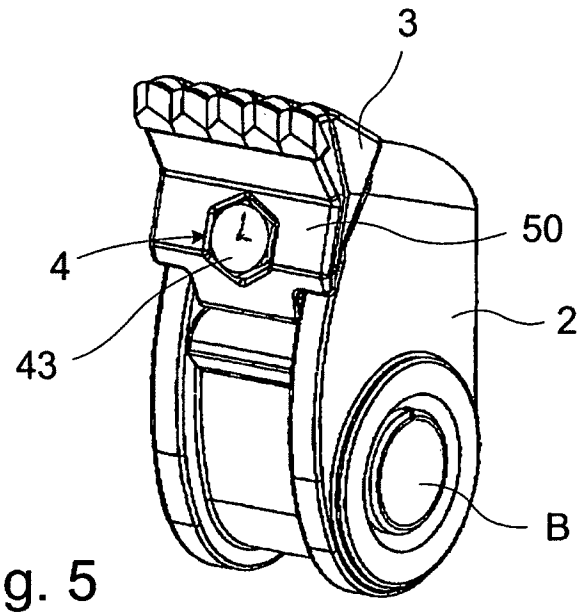
Figure 4:
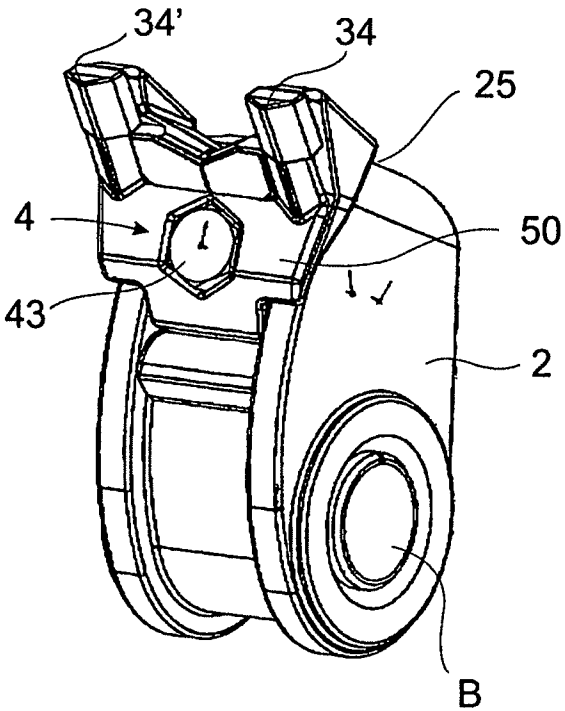
Figures 4A, 4B, 4C:
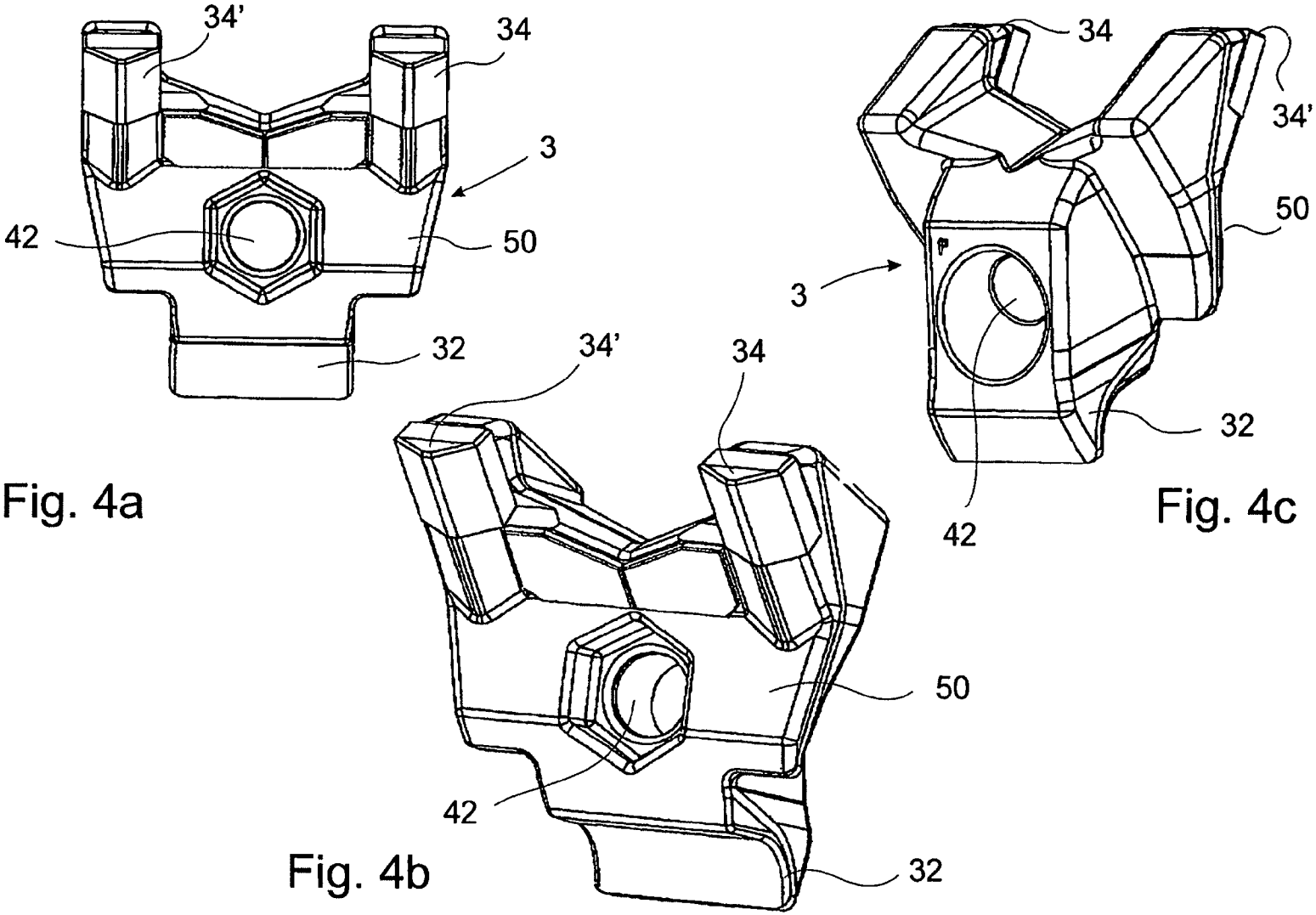
Figure 5C:
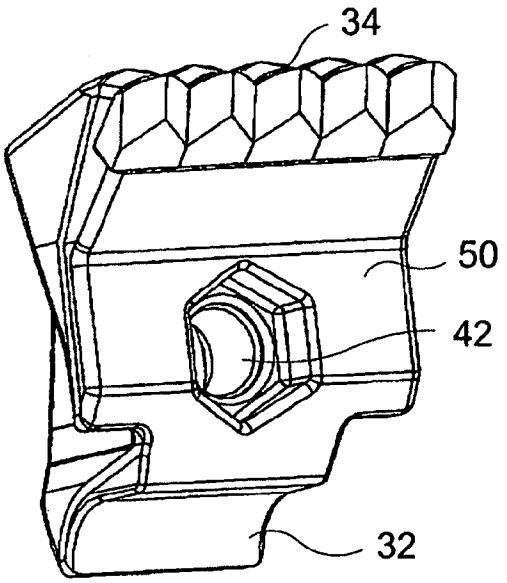
Figure 5B:
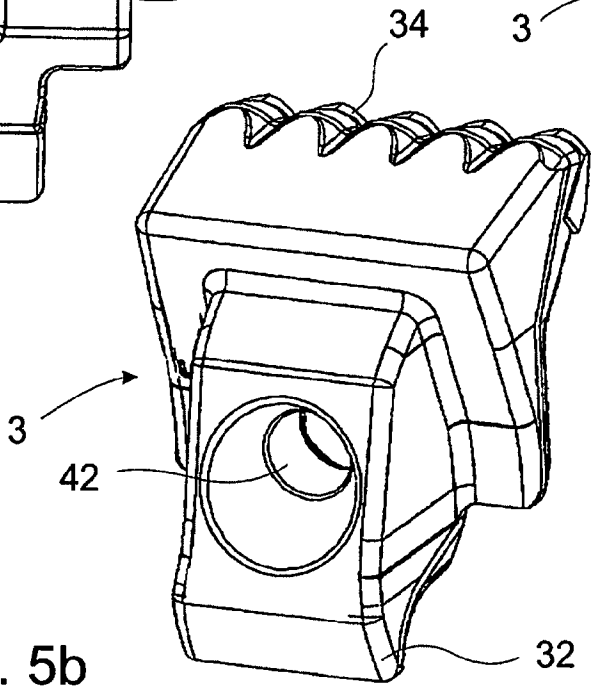
Figure 5A:
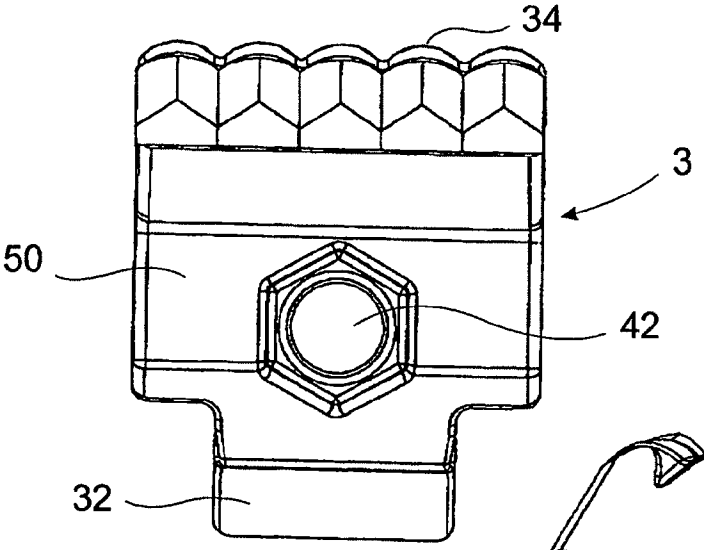

In the following the invention will be described in detail by means examples. In the drawings:

FIGS. 1*a* to 1*c* a first embodiment of a mallet according to the invention, FIGS. 1*d* to 1*f* several views of a cutting element according to the invention, FIG. 2 another embodiment of a mallet according to the invention, FIGS. 2*a* and 2*b* several views of the mallet according to FIG. 2, FIG. 3 three-dimensional presentation of a basic element according to the invention, FIGS. 4 to 6 other configuration of a mallet according to the invention, FIGS. 4*a* to 4*c* several views of a cutting element with wide web according to the invention, FIGS. 5*a* to 5*c* other views of a cutting element configured according to the invention.

FIG. 1*a* shows in a three-dimensional representation a mallet 1 according to the invention. The basic element 2 is here provided with a through bore hole B serving for connecting the mallet 1 with the rotor or a shaft of the comminution device, that is not shown. The basic element 2 is provided with a cutting insert 3 that is, as it can be seen, enclosed by the basic element 2 with rather its complete surface at its form-locking connection V. The cutting insert 3 has cutting edges or blade points 31, 31'. In the shown embodiment according to FIG. 1*a*, these blade points are soldered on, for example, as hard metal platelets. However, this is not a limiting embodiment, but only one of many possible modifications. The mallet carries, as indicated schematically by an arrow, reference number 1 as a whole. The form-locking connection V can be seen clearly better in the shown presentation according to FIG. 1*b*. It is indicated by "V" and is formed at the basic element 2 by a connecting knob 23 that is located in cutting direction S in the front of the basic element 2. Corresponding to this at the cutting insert 3 an appropriate connection catch 32 with a tapering extending downwards is provided that follows, of course, correspondingly the shape of the connecting knob 23 at the basic element 2. The connecting means 4 in the form of a screw 43 is provided in a sloping angle α with respect to the Y-axis of the mallet 1. It is clear here that the connecting means 4 generates in tightened condition power P from which power P1 results drawing or pressing the cutting insert 3 in the form-locking connection V of the basic element 2.

The angle α with respect to the Y-axis to the symmetry axis A of the screw 43 is in the shown embodiment about 105°. This angle, however, can be between 91° and 145°. The rotational axis R of the mallet is in the through bore hole B.

Referring to the rotational axis R at the point of the basic element 2 farthest away from the rotational axis R a free cut 25 is formed. This serves for comminuted material to be removed easier and, in particular, for keeping the wear at the basic element 2 low. 21 indicates the supporting area at the basic element 2 on which the cutting insert 3 is supported, when employed as intended. In the embodiment that cannot be seen here, now a V-shaped embodiment, that has been provided in the state of the art outwards tapering on both sides, is not necessary anymore. The cutting insert in FIG. 1*b* has a receiving pocket 34 for the blade points 31.

Furthermore, in FIG. 1*b* an opening 200 in the basic element 2 is indicated serving as grease nipple. It is, for example suited for receiving a grease nipple. Of course, also a lubricating catch or a lubricating supplying line can be provided there, by means of which grease can be supplied dosed. FIG. 1*c* shows identical reference numbers as in 1*a* and 1*b*, so that a repetition of the presentation is essentially not necessary. However, it can be seen very clearly in FIG. 1*c* that the distance h, starting at a notional line F extends as flight circle for the blade point 31 to a line G that is defined in that it is located at the point of the basic element 2 farthest away from the rotational axis R. Between the basic element 2 and the cutting insert 3 also a crescent-shaped chamber 24 is provided serving, if necessary, for cushioning the clamping force of the screw 43 or the clamping force of the connecting means 4. Also forces occurring during the intended use can be cushioned there accordingly.

FIGS. 1*d* to 1*f* show an embodiment of the mallet 1 according to the invention. However, here only the cutting insert 3 is shown. As it can be seen, the cutting insert 3 has on its side carrying the cutting edges receiving pockets 34 receiving blades. The connecting bore hole 42 shows that the representations 1*d* and 1*e* have been viewed from different angle positions. FIG. 1*d* shows the cutting insert 3 according to the invention in an embodiment in a side view. A catch edge 33, that can also define the height of removal of material of the cutting insert 3, is defined at the cutting insert at the side opposite the cutting direction S. Additionally, also the catch point can be found there where FIGS. 1*b* and 1*c* show the free cut 25. As it can be seen, the entire width of the cutting insert 3 is supported at least in its upper area on the basic element 2. For this purpose, at the basic element 2 the supporting area 21 is defined. The connecting insert 32 at the cutting element 3 is designed, as it can be seen, correspondingly thereto, so that it matches the connecting knob 23 of the basic element 2. Only this design of a semicircle-shaped or knob-like embodiment of this form-locking connection V makes it possible to reduce the appropriate savings with respect to manufacturing the cutting element according to the invention. The interaction of the form-locking connection V with the connecting means 4 makes for a very efficient solution that complies with all requirements and reduces, in particular, the material share of the cutting insert 3 compared with the entire material share of the mallet 1. This allows to minimize the occurring repairs when an appropriate comminution device is employed according to its intended use.

FIG. 2 shows another embodiment of a mallet 1 according to the invention. Here identical features are again indicated by identical reference numbers, so that presenting them again is not necessary here either. The cutting insert 3 has in the presentation according to FIG. 2 two cutting points 31, 31'. Otherwise, this mallet 1 corresponds essentially with the one shown in FIG. 1. FIG. 3 shows that the basic element 2 has a connecting recess 22 that is limited, at least on the side, by one web 26, 27 each. Furthermore, in the presentation according to FIG. 3 it can be seen very clearly where the connecting knob 23 is arranged. Furthermore, it can also be seen clearly that the supporting area 21 is designed only semicircle-like, and has no conical configuration with respect to a lateral extension. Accordingly, such a basic element can be manufactured very economically, as well as the cutting insert 3.

FIGS. 2*a* to 2*c* show several views of the mallet according to FIG. 2. The corresponding reference numbers have already been presented so that they will not be presented again.

FIGS. 4 to 6 show other embodiments of a mallet according to the invention. The web 50 located in the area of the connecting means at the cutting insert 3 is configured wider than in the preceding figures. The advantage is here that the cutting point extends beyond the edge of the basic element 2, and thus protects it additionally in the upper area. FIG. 6 indicates that the cutting edge 3 is configured swiveling, sliding or folding in the basic element 2 in the direction of arrow a. At the form-locking connection V designed analogously to the before described embodiments here the cutting insert 3 can be moved nicely in the basic element 2 what makes mounting and the later exchange considerably easier. What is accomplished here is a better protection of the basic element 2 altogether so that the lifetime of the basic element is further increased considerably. Otherwise, here also the already introduced reference numbers are used so that a presentation again is not necessary. FIGS. 4*a* to 4*c* show a cutting insert 3 with two cutting point, the cutting insert 3 also having a wide web 50.

FIGS. 5*a* to 5*c* also show a cutting insert 3 that is, however, designed here with a compact cutting edge area 34. Depending on the different tasks, these cutting inserts are equipped accordingly. Otherwise, here also identical reference numbers as before have been used so that these can be referred to expressly.

The invention has been described by means of examples. The claims filed now and along with the application later on are attempted formulations without prejudice for obtaining a broader protection.

References in the sub-claims refer to the further design of the matter of the main claim through the characteristics of the respective sub-claim. These are, however, not to be understood as a waiver for obtaining an independent, subjective protection for the characteristics of the referred sub-claims.

Characteristics only disclosed in the description so far, may now in the course of proceedings be claimed as being of inventive relevance, for example to distinguish from the state of the art.

The invention claimed is:

1. A mallet for comminution devices with a rotor or at least one shaft on or at which the mallet can be fastened, consisting of a basic body provided with a through bore hole, wherein the through bore hole is provided for connecting the mallet with the rotor or the shaft, and a cutting insert that can be releasably/fixedly connected with the basic body by at least one form-locking connection as well as at least one connecting means, the at least one connecting means exerts power drawing or pressing the cutting insert in the at least one form-locking connection of the basic body, wherein referring to power a power results drawing or pressing the cutting insert in a sloping angle with reference to an axis of the mallet and a symmetry axis of the at least one connecting means essentially parallel to the axis in the basic body.

2. The mallet according to claim 1, wherein, for forming the at least one form-locking connection, the cutting insert can be swiveled or turned in the basic body.

3. The mallet according to claim 1, wherein for forming the at least one form-locking connection a connection catch is provided at the cutting insert and a connecting knob in the basic body, and a connection catch and the connecting knob have corresponding forms.

4. The mallet according to claim 1, wherein a guide knob forms with a connection recess in the basic body or its side limits a guide for swiveling in the cutting insert, the at least one connecting means is arranged corresponding with the angle sloping opposite the cutting direction in the mallet, and generates or effects the power in tightened condition.

5. The mallet according to claim 1, wherein the at least one connecting means is arranged corresponding with the angle sloping opposite a cutting direction of the mallet, and generates or effects the power in tightened condition and the angle is between 91° and 145°.

6. The mallet according to claim 5, wherein the angle is 105°.

7. The mallet according to claim 1, wherein the at least one connecting means is formed by a screw connection, consisting of correspondingly provided with connection bore holes in the basic body and in the cutting insert, a screw designed as a machine screw as well as a nut that is supported by a washer and, if necessary, is secured against unintended release by means of a circlip and/or the connection bore holes are configured sloping conically opposite a cutting direction.

8. The mallet according to claim 1, wherein the basic body is defined on its side facing the cutting insert to a defined distance from a flight circle, defined by a blade point of the cutting insert, in order to form a support area and/or a free cut for the cutting insert.

9. The mallet according to claim 8, wherein the distance from the flight circle of the blade point of the cutting insert and the flight circle of the basic body is defined at its point farthest away from the rotational axis.

10. The mallet according to claim 1, wherein at the cutting insert at the side opposite the cutting direction a catch edge is defined defining the distance to a free cut and thus a removal height of material of the cutting insert and/or the entire width of the cutting insert is supported on or at the basic body.

11. The mallet according to claim 10, wherein the cutting insert is designed such that it can, at least partly, be inserted, with its part of the at least one form-locking connection, in the basic body.

12. The mallet according to claim 1, wherein a supporting area in the basic body is provided in a connection recess limited at least on the side by one web each and/or the ratio of the cross section surfaces of the basic body and the cutting insert, and the ratio of the mass of the basic body to cutting insert, respectively, is between 1 to 2 and 1 to 5.

13. The mallet according to claim 12, wherein the ratio of the mass of basic body to cutting insert is 1 to 3.

14. The mallet according to claim 1, wherein the cutting insert has a web in the area where the at least one connecting means is provided and/or a connecting knob is provided and the connecting knob and a connection catch have an exterior or inner radius of 15 to 20 mm with respect to a third of a circle of outer or inner curvatures of the connecting knob and the connection catch.

15. The mallet according to claim 14, wherein the web has the same width as a connection recess, or extends in built-in or assembled condition laterally at least to a edge of the basic body, or beyond an edge of the basic body.

16. The mallet according to claim 1, wherein a connecting knob is provided and the connecting knob is, seen in a cutting direction, provided in the front part of the basic body and/or the cutting insert is configured as an exchange blade having at least two cutting points.

17. The mallet according to claim 1, wherein at the cutting insert edges and/or sides pointing in a cutting direction hardened areas, hard facings, welding-ons, hard metal coatings are provided as cutting points.

18. The mallet according to claim 1, wherein cutting edges are provided and at least the cutting edges of the cutting insert are formed of hard metal.

19. The mallet according to claim 1, wherein cutting points are provided and the cutting points are characterized by different point shapes.

20. The mallet according to claim 1, wherein cutting edges are provided and the cutting edges are designed wedge-like and/or V-shaped in cutting direction.

21. The mallet according to claim 1, wherein at the basic body at least one opening is provided on the side of a bottom element opposite the cutting direction, extending at least to the through bore hole and serving for holding a lubricator.

22. The mallet according to claim 1, wherein the basic body and/or a cutting element have been manufactured at least partly as a forged/punched part.

23. A mallet for comminution devices with a rotor or at least one shaft on or at which the mallet can be fastened, consisting of a basic body provided with a through bore hole, wherein the through bore hole is provided for connecting the mallet with the rotor or the shaft, and a cutting insert that can be connected releasably/fixedly with the basic body by at least one form-locking connection as well as at least one connecting means, the at least one connecting means exerts a power drawing or pressing the cutting insert in the at least one form-locking connection of the basic body according, wherein for forming the at least one form-locking connection the cutting insert can be swiveled or turned in the basic body.

24. A comminution device with at least one mallet according to claim 23.

25. The comminution device according to claim 24, wherein the comminution device is a clipper.

26. A comminution device with at least one mallet according to claim 1.

27. The comminution device according to claim 26, wherein the comminution device is a clipper.

* * * * *